US012799858B2

(12) United States Patent
Wee et al.

(10) Patent No.: US 12,799,858 B2
(45) Date of Patent: Nov. 17, 2026

(54) ACTIVE COOLING METHODS AND SYSTEMS FOR DOWNHOLE TOOLS

(71) Applicant: BP Exploration Operating Company Limited, Middlesex (GB)

(72) Inventors: Joseph K.S. Wee, Reading (GB); Andre De Garis Nicolle, London (GB); Alan Agurto Goya, Solihull (GB)

(73) Assignee: BP Exploration Operating Company Limited (GB)

( * ) Notice: Subject to any disclaimer, the term of this patent is extended or adjusted under 35 U.S.C. 154(b) by 0 days.

(21) Appl. No.: 19/330,082

(22) Filed: Sep. 16, 2025

(65) Prior Publication Data

US 2026/0085606 A1 Mar. 26, 2026

(30) Foreign Application Priority Data

Sep. 25, 2024 (GB) ..... 2414080

(51) Int. Cl.
*E21B 47/017* (2012.01)

(52) U.S. Cl.
CPC ..... *E21B 47/0175* (2020.05)

(58) Field of Classification Search
CPC ..... E21B 47/017
See application file for complete search history.

(56) References Cited

U.S. PATENT DOCUMENTS 4,375,157 A 3/1983 Boesen
5,931,000 A 8/1999 Turner et al.
2004/0242044 A1* 12/2004 Head ..... E21B 17/0285 439/190
2006/0102353 A1 5/2006 Storm et al.
2006/0162931 A1* 7/2006 Mayes ..... E21B 47/017 166/57
2011/0203798 A1* 8/2011 Herrera ..... E21B 47/0175 166/57
2018/0347336 A1 12/2018 Kusmer et al.
2024/0133267 A1 4/2024 Chen et al.

OTHER PUBLICATIONS

UKIPO Combined Search and Examination Report dated Mar. 24, 2025, for Application No. GB2414080.8.
International Search Report and Written Opinion dated Nov. 11, 2025, for Application No. PCT/EP2025/076585.

* cited by examiner

*Primary Examiner* — William D Hutton, Jr.
*Assistant Examiner* — Avi T Skaist
(74) *Attorney, Agent, or Firm* — Conley Rose, P.C.

(57) ABSTRACT

A well system includes a surface electrical power source located at a surface, a conveyance string extending from the surface and into a wellbore extending from the surface and penetrating into a subsurface region, and an actively cooled downhole tool coupled to the conveyance string. The actively cooled downhole tool includes a tool housing coupled to the conveyance string and including a receptacle, an electronic device received in the receptacle of the tool housing, an active cooling element coupled to the tool housing and connected to the surface electrical power source through an electrical power conductor to the conveyance string, whereby the active cooling element is configured to transfer heat from the electronic device to a heat sink in response to receiving power from the surface electrical power source.

28 Claims, 10 Drawing Sheets

ACTIVE COOLING METHODS AND SYSTEMS FOR DOWNHOLE TOOLS

CROSS-REFERENCE TO RELATED APPLICATIONS

This application claims priority to and benefit of United Kingdom patent application No. 2414080.8 filed Sep. 25, 2024, and entitled "Active Cooling Methods and Systems for Downhole Tools," which is hereby incorporated herein by reference in its entirety for all purposes.

STATEMENT REGARDING FEDERALLY SPONSORED RESEARCH OR DEVELOPMENT

Not applicable.

BACKGROUND

Energy resources such as heat from geothermal reservoirs and hydrocarbons from subsurface deposits may be obtained via the drilling of wellbores extending through a subsurface region or strata. The wellbore may be formed using a drilling system including a drill string configured to convey a drilling fluid into the wellbore and drill through the subsurface region. A bottom hole assembly (BHA) may be connected to a downhole end of the drill string and may include drill pipes, drill collars, and a drill bit located at an end thereof and which is configured to cut into the subsurface region. The BHA may also include downhole tools such as directional subs, mud motors, rotary steerable systems (RSS), sensors, ranging tools, measurement while drilling (MWD)/logging while drilling (LWD) tools, control devices, and other specialized instruments to efficiently carry out drilling and downhole operations.

SUMMARY

In an embodiment, an active cooling system for downhole tools comprises a surface electrical power source located at a surface, a conveyance string extending from the surface and into a wellbore extending from the surface and penetrating into a subsurface region, wherein the conveyance string comprises an electrical power conductor extending along the conveyance string and connected to the surface electrical power source, and an actively cooled downhole tool coupled to the conveyance string, wherein the actively cooled downhole tool comprises a tool housing coupled to the conveyance string and comprising a receptacle, and an electronic device received in the receptacle of the tool housing, and an active cooling element coupled to the tool housing and connected to the surface electrical power source through the electrical power conductor to the conveyance string, wherein the active cooling element is configured to transfer heat from the electronic device to a heat sink in response to receiving power from the surface electrical power source. In some embodiments, the well system includes a phase change material coupled to the active cooling element and configured to buffer the electronic device under power or temperature fluctuations or failure. In some embodiments, the conveyance string is configured to supply continuous power to the active cooling element. In certain embodiments the conveyance string comprises a plurality of tubular members coupled end to end with threaded connections and a fluid passage. In other embodiments, the active cooling element comprises a thermoelectric material. In some embodiments, the thermoelectric material has a dimensionless figure-of-merit (ZT) value of 0.5 or greater. In certain embodiments, the active cooling element has an ambient temperature greater than 100 °C. In certain embodiments, the active cooling element has an ambient temperature greater than 400 °C. In some embodiments, the active cooling element has an ambient temperature greater than 500 °C. In some embodiments, the active cooling element has an ambient temperature up to 600 °C. In other embodiments, the active cooling element is configured to provide a temperature differential of 50 °C or greater. In some embodiments, the actively cooled downhole tool comprises logging while drilling (LWD) tools, measurement while drilling (MWD) tools, ranging tools, directional steering tools, or any other downhole tools that require electronic components.

In an embodiment, a method for deploying an actively cooled downhole tool in a wellbore extending from a surface and penetrating into a subsurface region comprises (a) lowering, by a conveyance string, the actively cooled downhole tool from the surface and into the wellbore, the actively cooled downhole tool comprising an electronic device and an active cooling element, (b) transferring, by the conveyance string, power from the surface to the active cooling element, wherein the conveyance string comprises an electrical power conductor extending along the conveyance string and connected to a surface electrical power source, and (c) transferring, by the active cooling element, heat from the electronic device to a heat sink in response to (b). In some embodiments, the conveyance string is configured to supply continuous power to the active cooling element. In certain embodiments, the conveyance string comprises a plurality of tubular members coupled end to end with threaded connections and a fluid passage. In other embodiments, the active cooling element comprises a thermoelectric material. In some embodiments, the thermoelectric material has a dimensionless figure-of-merit (ZT) value of 0.5 or greater. In certain embodiments, the active cooling element has an ambient temperature greater than 100 °C, 400 °C-500 °C, or up to 600 °C. In other embodiments, the active cooling element is configured to provide a temperature differential of 50 °C or greater. In some embodiments, the actively cooled downhole tool comprises logging while drilling (LWD) tools, measurement while drilling (MWD) tools, ranging tools, directional steering tools, or any other downhole tools that requires electronic components.

In an embodiment, an actively cooled downhole tool deployable in a wellbore extending from a surface and penetrating into a subsurface region comprises a tool housing extending between an uphole end, a downhole end opposite the uphole end, and defining a receptacle, an electronic device receivable in the receptacle of the tool housing, a tool power connector coupled to the housing at the uphole end thereof for connecting to a mating power connector of a separate tool connected to a surface electrical power source, and an active cooling element coupled to the tool housing and connected to the tool power connector, wherein the active cooling element is configured to transfer heat from the electronic device to a heat sink in response to receiving power from the surface electrical power source through the tool power connector. In some embodiments, the actively cooled downhole tool, further comprises an enclosure located in the tool housing and which defines a thermally insulated chamber in which the active cooling element is received. In certain embodiments, the active cooling element comprises a plurality of single stage thermoelectric modules or a plurality of multi-stage thermoelectric modules. In other embodiments, the enclosure defines a plurality of heat cascading, thermally insulated chambers each containing one or more heat conductors, and one of a plurality of the active cooling elements. In some embodiments, each of the thermally insulated chamber contains a phase change material. In certain embodiments, the phase change material of each thermally insulated chamber has a unique activation temperature. In other embodiments, an electronic device is coupled to a thermoelectric module and surrounded by a phase change material. In some embodiment, the electronic device is coupled to a one or more heat conductors having an upstream end that is sandwiched between the electronic device and a thermal insulator and an opposing downstream end that is distal the electronic device.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
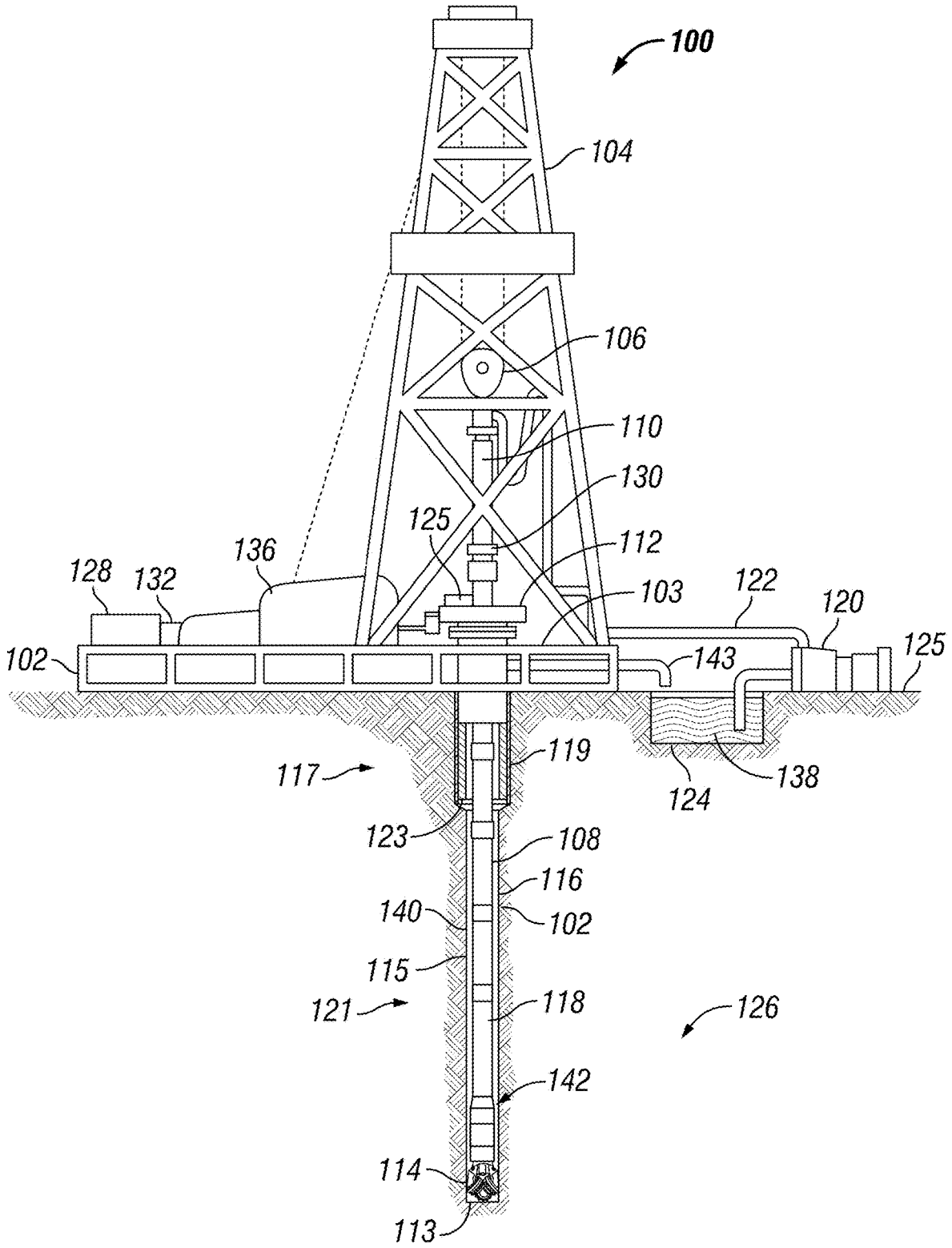
FIG. 1 is a schematic diagram of a drilling system according to some embodiments.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

As described above, wellbores may be drilled through a subsurface region in order to extract usable energy from the subsurface region in the form of geothermal energy, hydrocarbons, and the like. In addition, wellbores may be drilled for other purposes such as injection wells, test wells, wells for subsurface storage and the like.

Such wellbores drilled into subsurface regions may extend thousands or tens of thousands of feet beneath the surface with the downhole environment subject to extreme pressures, temperatures, as well as the presence of corrosive and destructive materials to which equipment of the drilling system (e.g., the drill string, BHA) are exposed during operation. In certain applications, the downhole environment may present challenges to maintaining the integrity and reliability of downhole tools present therein due to vibration, harsh chemicals, and extreme temperatures and pressures within the downhole environment. As an example, downhole temperatures may reach 300 °C (~570 °F) or greater. These extreme temperatures may be particularly problematic for downhole electrical equipment of the drilling system (e.g., MWD tools, LWD tools, and the like) which may be particularly sensitive (relative to the downhole mechanical equipment of the drilling system) to elevated temperatures making it a particularly difficult challenge to successfully operate such equipment downhole particularly in high depth/high temperature applications. For example, the consistent exposure of electrical equipment (particularly digital electronics) to high temperatures (e.g., temperatures that may obtain in at least some downhole environments) can cause drift, non-linearity of response, reduced response, and even complete failure (e.g., physical damage) to the electrical equipment.

Conventionally, passive cooling mechanisms have been used to regulate the temperature of downhole electrical equipment such as electronics of the BHA (e.g., MWD tools, LWD tools). Such passive cooling mechanisms typically form a thermal barrier (e.g., an interface having a high thermal resistance) between the electrical equipment and the ambient downhole environment. For instance, the downhole electronics may be encapsulated or otherwise protected by thermally insulating materials. However, such passive cooling mechanisms only serve to obstruct the transference of heat from the downhole environment to the downhole electronics, and do not provide direct cooling of the downhole electronics such that heat may be transferred from the downhole electronics to a separate heat sink. Thus, as used herein, the term "passive cooling" refers to unpowered cooling mechanisms that rely on thermally insulating materials (including the lack of materials such as the formation of a vacuum) to form a thermal barrier between the equipment to be passively cooled and a heat source (e.g., the downhole environment). Conversely, the term "active cooling" used herein refers to powered cooling mechanisms that actively transfer heat from the equipment to be actively cooled to a heat sink.

While passive cooling mechanisms may be used to protect at least some downhole electronics in some applications in which the downhole environment is manageable, with the increasing need for additional energy resources, it is desired to tap into the heat stored beneath the surface or seek out new hydrocarbon reserves located deep within a strata where downhole conditions are generally more extreme. For instance, many hydrocarbon reserves are situated in high-pressure/high-temperature (HPHT) or ultra-HPHT wells, characterized by extreme conditions with reservoir temperatures ranging, for example, from 175 °C to 220 °C (~350 °F-400 °F) or more, which can sometimes necessitate near-bit measurement and construction techniques to gather real-time data and adjust the drilling process as needed for efficiency and accuracy.

The challenge posed by high temperatures and the strain such conditions place on existing downhole equipment is increasingly apparent, particularly as drilling depths become more restricted. In such high-temperature environments, conventional downhole tools (e.g., MWD and LWD tools, ranging tools etc.) utilizing passive cooling mechanisms for cooling downhole electronics are prone to exceedingly high failure rates. Particularly, the temperature of the downhole environment in HPHT wells, for example, may overwhelm the thermal barrier formed by the passive cooling mechanism (e.g., due to the increased temperature difference between the insulated downhole electronics and the downhole environment) resulting in potential failure of the downhole electronics. Consequently, drilling in these conditions is fraught with complexity and high costs, often resulting in accidents and accelerated equipment degradation. Furthermore, geothermal wells can have temperatures reaching up to 300 °C (~570 °F) or more. These extreme temperatures present even more difficulties as downhole electronics need to withstand the thermal stresses and maintain functionality in such harsh conditions. Thus, downhole electronics in HPHT or geothermal environments may need to be cooled during operation in order to safely and accurately carry out downhole operations.

While some active cooling mechanisms have been attempted, such conventional active cooling mechanisms typically rely on battery power via a downhole battery pack conveyed into the wellbore along with the downhole tool, limiting the cooling power of the conventional active cooling element. Particularly, downhole battery packs are subject to onerous storage constraints presented by the downhole environment (e.g., limited space, extreme conditions, limited amount of power to supply). Thus, conventional active cooling mechanisms have generally failed to address the limitations of passive cooling mechanisms.

Accordingly, embodiments of downhole tools are described herein that include an active cooling element configured to transfer heat from an electronic device (e.g., downhole electronics) deployed in a wellbore to a separate heat sink in response to receiving power from a surface power supply that does not face the same limitations faced by downhole deployable power supplies such as downhole battery packs. In this manner, the surface power system may supply the active cooling element in the wellbore with continuous power far in excess of that which can be delivered by downhole power supplies such as downhole battery packs.

Embodiments of active cooling elements described herein offer advantages over passive cooling systems and conventional active cooling systems (e.g., battery powered active cooling systems) in terms of responsiveness, cooling capacity, temperature regulation and reliability. In some embodiments, the active cooling element comprises a thermoelectric cooler (TEC) configured to cool a selected device (e.g., downhole electronics) in response to receiving electrical power. Generally, TECs leverage the Peltier effect whereby a temperature difference is created at the junction of two different electrically conductive materials when an electric current is passed through the conductive materials. By leveraging the Peltier effect, heat can be absorbed or released at the junction of the two dissimilar conductive materials depending on the direction of electrical current flow through the TEC. TECs offer advantages over other active cooling elements in at least some applications. For example, TECs are compact and light weight compared to other active cooling elements, and produce minimal vibration during operation since they do not have any moving parts. Particularly, this lack of mechanical wear of the TEC increases the lifespan and lowers maintenance requirements. Current data show that the mean life between failures (MTBF) of TECs exceed 100,000 hours in ambient temperature. Additionally, TECs do not require a separate refrigerant, thereby saving space and reducing the environmental impact of the TEC relative to other active cooling elements which utilize refrigerant.

Furthermore, TECs can be precisely controlled (e.g., via controlling the power supplied to the TEC) and can be mounted in any orientation making them suitable for a wide range of applications and operating environments including downhole environments with limited space. While TECs comprise powerful active cooling elements (e.g., having a greater cooling capacity than at least some alternative active cooling elements), generally their efficiency is limited relative to alternatives. Particularly, conventional TECs have limited coefficient of performance (COP) and are constrained on the total heat flux (heat flow) that they are able to move or transport per unit area. For example, below temperatures of around 130 Kelvin (~140 °C or 230 °F) and where a large temperature differential exists across the junction of the two dissimilar conductive materials, the COP of conventional TECs decrease significantly. This constraint is mainly due to limitations in the amount of power supplied and materials used in the TEC construction, both of which significantly influence the cooling performance of the TECs.

For example, higher power inputs generally should result in greater temperature differentials across the TEC junction leading to more effective cooling. However, performance of the TEC is limited by the properties of the material used. For example, excessive power input can cause overheating and reduce the COP of the TEC, thereby limiting cooling performance. Additionally, the materials used in the TEC determines properties such as electrical conductivity, thermal conductivity, etc., which are essential for the thermoelectric effect induced by the TEC, and thus, the cooling performance of the TEC. Therefore, TECs have generally been avoided in active cooling elements used to cool downhole tools given the high temperatures encountered in the downhole environment and the limited amount of energy and power providable by downhole power supplies such as downhole battery packs.

Accordingly, embodiments disclosed herein, include active cooling elements in the form of TECs that combine continuous power supply with high efficiency thermoelectric materials to enable drilling temperature tolerance to temperatures in excess of 100 °C (e.g., between 200 °C and 600 °C). Embodiments disclosed herein also include active cooling methods and systems for downhole tools which couple a TEC containing a thermoelectric material having a dimensionless figure-of-merit (ZT) value of 0.5 or greater, with a powered conveyance string configured to provide continuous power. Furthermore, embodiments disclosed herein, include active cooling methods and systems for cooling downhole tools configured to provide a temperature differential of 50 °C, 100 °C to 200 °C, or greater than 200 °C.

Referring initially to FIG. 1, an embodiment of a well system 100 is shown. Particularly, well system 100 comprises a drilling system in this exemplary embodiment and thus may also be referred to herein as drilling system 100. However, in other embodiments, well system 100 may comprise well systems other than drilling systems including completion systems, production systems, injection well systems, geothermal well systems, subsurface storage systems, and others.

Drilling system 100 includes a derrick 104 supported by a drilling platform 102. While the drilling system 100 is shown in FIG. 1 as a land-based system, embodiments of the drilling system 100 are also applicable to offshore wells. In such embodiments, a conveyance string 108 of drilling system 100 may extend from a surface platform through a riser assembly, a subsea blowout preventer, and a subsea wellhead into the subsea formations.

In this exemplary embodiment, the derrick 104 of drilling system 100 includes a floor 103 and a traveling block 106 for raising and lowering the conveyance string 108 formed from a plurality of tubular members coupled end-to-end (e.g., threadably via rotary shouldered threaded connections) along the longitudinal length of conveyance string 108. Conveyance string 108 comprises a drill string in this exemplary embodiment and thus also may be referred to as drill string 108; however, the configuration of conveyance string 108 may vary. For example, in other embodiments, conveyance string 108 may comprise a casing string, a production string, a work string, and the like. In this exemplary embodiment, derrick 104 supports a rotary table 112 that is rotated by a prime mover such as an electric motor controlled by a motor controller. A kelly 110 supports the drill string 108 as it is lowered through the rotary table 112. In some embodiments of the drilling system 100, a top drive may instead be used to rotate the drill string 108 rather than rotation by the rotary table 112 and the kelly 110.

Drill string 108 extends downward through the rotary table 112 and into a wellbore 116 which extends through a subsurface region 126 located beneath the surface 125. Subsurface region 126 comprises an earthen formation in this exemplary embodiment. Alternatively, subsurface region 126 may comprise a subsurface region of another planet or astronomical object (e.g., an asteroid). In this exemplary embodiment, drill string 108 generally includes a plurality of separate drill pipe joints 118 connected end-to-end. In addition, drilling system 100 includes a bottom hole assembly (BHA) 142 that is coupled to a downhole end of the drill string 108 and includes a drill bit 114 at a terminal end thereof and includes other tools such as, for example, a mud motor, drill collars, and other downhole tools. Drill bit 114 of BHA 142 cuts into a subsurface region 126 when drill bit 114 is rotated with weight-on-bit (WOB) to thereby form wellbore 116. In this exemplary embodiment, WOB, which impacts the rate of penetration (ROP) of drill bit 114 through subsurface region 126, is controlled by a drawworks 136 of drilling platform 102. In some embodiments, BHA 142 comprises a downhole mud motor configured to rotate the drill bit 114 in response to the pumping of a pressurized drilling fluid 138 fluid downhole through a central passage of the drill string 108 to the BHA 142 connected therewith.

As indicated above, in this exemplary embodiment, during drilling operations a suitable drilling fluid 138 from a mud tank 124 is circulated under pressure through the drill string 108 by a surface mud pump 120 of drilling system 100. The drilling fluid 138 passes from the surface mud pump 120 into the drill string 108 via a fluid line 122 and the kelly 110. The drilling fluid 138 is discharged near or at a bottom 113 of the wellbore 116 through nozzles formed in the drill bit 114. The drilling fluid 138 circulates to the surface through an annulus 140 formed between the drill string 108 and a sidewall 115 of wellbore 116. The drilling fluid 138 transports cuttings from the wellbore 116 and aids in maintaining wellbore integrity.

In this exemplary embodiment, various sensors are employed in drilling system 100 (some of which are shown schematically in FIG. 1) for monitoring a variety of surface-controlled drilling parameters and downhole conditions. In some embodiments, drilling system 100 includes downhole electrical equipment such as, for example, sensors associated with BHA 142. For instance, the downhole mud motor may include an electronic sensor for measuring rotational speed, temperature, pressure, etc., of the downhole mud motor. The BHA 142 may also include a measurement-while-drilling and/or a logging-while-drilling assembly containing sensors for measuring drilling dynamics, drilling direction, subsurface region parameters, downhole conditions such as, for example, drilling fluid ECD and pressure within annulus 140, and so on. Additional sensors may be included in or at the drill bit 114 to provide measurements of subsurface region parameters, drilling parameters, etc. at the drill bit 114. For example, a torque sensor located at the drill bit 114 may measure torque applied at the drill bit 114 to remove material at the end of the wellbore 116. Similarly, a sensor located at the drill bit 114 may measure weight on the drill bit 114. Additional sensors at the drill bit 114 may measure subsurface region parameters or other parameters of interest.

In addition, drilling system 100 may include other kinds of downhole electrical equipment beyond sensors such as computer systems including a memory device (e.g., a non-transitory memory device) and a processor configured to execute instructions stored on the memory device. Such devices may be used for logging, communication, or other purposes. Additionally, downhole tools with electrical equipment may, in addition to being incorporated into BHA 142, may be positioned along the drill string 108 at locations within wellbore 116 but spaced from the BHA 142.

Figure 2:
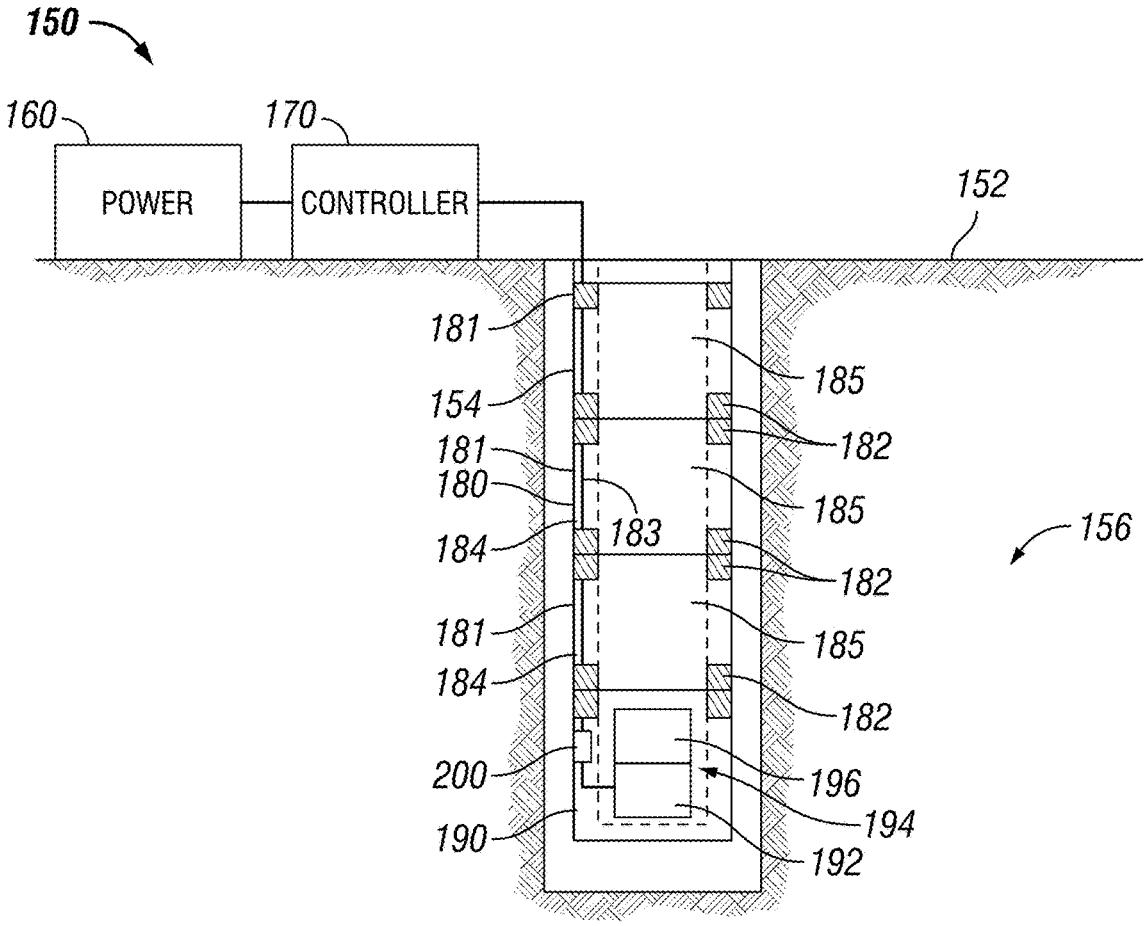
FIG. 2 is a schematic diagram of an exemplary well system in accordance with principles disclosed herein.

Referring to FIG. 2, a schematic diagram of an exemplary well system 150 in accordance with principles disclosed herein is shown. It may be understood that well system 150 may include additional features and equipment not shown in FIG. 2, which illustrates well system 150 in a simplified form. In this exemplary embodiment, well system 150 generally includes a surface electrical power source 160 and a surface controller 170 located at the surface 152, a conveyance string 180, and a downhole tool 190 that comprises an active cooling module 200. Surface electrical power source 160, surface controller 170, and other equipment of well system 150 form a surface assembly of well system 150 while conveyance string 180 and downhole tool 190 form a downhole assembly of well system 150 positionable in a wellbore 154 that penetrates a subsurface region 156. The surface electrical power source 160 (e.g., a power generation unit) of well system 150 is configured to deliver electrical power from the surface 152 to downhole tool 190 positioned in wellbore 154 via one or more elongate electrical power conductors 184 as will be described further herein.

Surface electrical power source 160 may vary in configuration depending on the particular application. For example, in some embodiments, surface electrical power source 160 may comprise one or more electrical generators driven by one or more prime movers each comprising an internal combustion engine (ICE) such as a piston engine, a gas turbine, and the like. Alternatively, surface electrical power source 160 may comprise an electrical connection (e.g., an electrical switchgear) with an electrical power grid that services the location of the wellsite of well system 150. In still other embodiments, surface electrical power source 160 may comprise an electrical battery or bank of electrical batteries.

Surface controller 170 is in signal communication with surface electrical power source 160 and is configured to regulate the power output transmitted from surface electrical power source 160 to downhole tool 190. In some embodiments, surface electrical power source 160 may also include sensors and other safety mechanisms for monitoring the operation and performance of surface electrical power source 160. Surface controller 170 may comprise or be implemented by a computer system including a processor and a memory device encoded with instructions executable by the processor. While surface controller 170 is shown in FIG. 2 as located proximal wellbore 154, in other embodiments, surface controller 170 may be distal the wellbore 154.

The conveyance string 180 of well system 150 extends from the surface 152 and into and through the wellbore 154 and serves as the mechanisms for deploying the downhole tool 190, suspended from a downhole end of conveyance string, into and from wellbore 154. In this exemplary embodiment, conveyance string 180 comprises a plurality of tubular members or joints 181 each having a central passage 185 and which are coupled end-to-end via corresponding rotary mechanical connections (e.g., threaded connections). In other embodiments, the configuration of conveyance string 180 may vary. For example, in other embodiments, conveyance string 180 may comprise a continuous tubular member in the form of, for instance, coiled tubing.

In this exemplary embodiment, each tubular joint 181 additionally includes a pair of electrical power connectors 182 located at opposing longitudinal end thereof, and an elongate electrical power conductor 184 extending between the pair of electrical power connectors 182 to provide an electrical connection therebetween. The electrical power conductor 184 may be embedded in a generally cylindrical body of the tubular joint 181 so as to protect or isolate electrical power conductor 184 from the central passage 185 of tubular joint 181. In some embodiments, electrical power connectors 182 comprise wireless electrical connectors that permits relative rotation between adjacent tubular joints 181 while maintaining an electrical connection therebetween. For example, electrical power connectors 182 may comprise electromagnetic connectors comprising a magnet (e.g., a permanent magnet) and an electrically conductive coil wound about the magnet for communicating electrical signals and power across the wireless electrical connection formed by the electromagnetic connectors. In other embodiments, electrical power connectors 182 may comprise a rotating slip ring connector comprising, for example, a rotor, a stator, conductive brushes and conductive rings which allows for continuous transmission of electrical signals and power between the stationary and rotating parts.

Generally, conveyance string 180 is configured to deploy downhole tool 190 to a desired depth and supply power to downhole tool 190 via the plurality of tubular joints 181. Mechanical connectors of the bodies of the tubular joints 181 mechanically couple the tubular joints 181 together while electrical power connectors 182 and electrical power conductors 184 of tubular joints 181 facilitate the transfer of electrical signals and power along conveyance string 180 between surface controller 170 and downhole tool 190 by establishing a continuous electrical pathway or circuit (depicted by 183 in FIG. 2) to ensure a seamless connection between electrical power conductor 184, thereby allowing electrical power to flow uninterrupted to downhole tool 190. To state in other words, the electrical pathway 183, along with potentially other equipment, is defined by the electrical power connectors 182 and the electrical power conductors 184 of the tubular joints 181 forming conveyance string 180.

In this exemplary embodiment, downhole tool 190 of well system 150 comprises an outer tool housing 192 coupled to the downhole end of conveyance string 180 (e.g., via a rotary mechanical connection such as a threaded connection), an electronic device 196 received in a receptacle 194 of the tool housing 192, and an active cooling module 200 coupled to the tool housing 192 and electrically connected to the surface electrical power source 160 through the electrical pathway 183 whereby active cooling module 200 may transfer heat from the electronic device 196 to a separate heat sink (e.g., drilling mud or/and other fluids circulating through the wellbore 154) in response to receiving power from the surface electrical power source 160. It should be noted that the embodiments described in FIG. 2 are exemplary only and are not limiting. Many variations and modifications are possible and are within the scope of the disclosure. For example, the active cooling module 200 may be integrated into the downhole tool assembly either as a separate module or as part of the overall tool structure, and configured for efficient heat transfer and cooling of the downhole tool. The tool housing 192 may be filled with thermally sensitive fluid including cooling lubricants, air, liquids or other fluids that enhance cooling of the downhole tool 190. In some embodiments, temperature measurement and temperature control devices may be coupled to the tool housing 192 to enable temperature monitoring and to control the power applied to electronic device 196.

Active cooling module 200 of well system 150 is generally configured to transfer heat or thermal energy from a first physical location to a second physical location that is spaced from the first physical location in response to receiving electrical power. In certain embodiments, the active cooling module 200 comprises a downhole heat pump configured to transfer or pump heat from a downhole tool or other device to the surrounding wellbore environment. In this exemplary embodiment, active cooling module 200 utilizes the Peltier effect to transfer heat from the electronic device 196 to a heat sink (e.g., surrounding drilling fluid) in response to receiving power from the surface electrical power source 160. The term "Peltier effect" refers generally to the phenomenon whereby a temperature difference is created at the junction of two dissimilar conductors or semiconductors when an electric current flows through them. In some embodiments, the active cooling module 200 comprises a plurality of thermoelectric modules or elements arranged in a predefined sequence or arrangement (e.g., arranged in series) to thermoelectrically cool a selected device such as an electronic device. Each thermoelectric element may comprise a pair of dissimilar semiconductor materials, such as "n-type" and "p-type" materials, joined together such that when current passes through the thermoelectric element, one side of the element becomes cooler while the other (e.g., opposing) side heats up, thereby creating a temperature gradient. This electrically driven temperature gradient may be utilized for active cooling by positioning the cold side adjacent the selected device to be cooled such that heat may be transferred from the device to the hot side of the thermoelectric element, across the thermoelectric element, and from the hot side of the thermoelectric element to a heat sink located (thermally) downstream from the hot side of the thermoelectric cooler. In a well system (e.g., well system 150), the cold side of the thermoelectric elements is in contact with the electronic device (e.g., electronic device 196) while the hot side is exposed to the heat sink (e.g., drilling fluid).

Figure 3A:
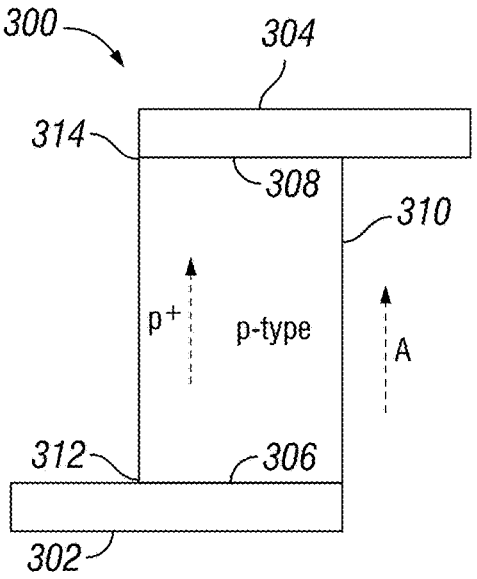
FIGS. 3*a* and 3*b* are schematic diagrams of examples of thermoelectric elements in accordance with principles disclosed herein.
Figure 3B:
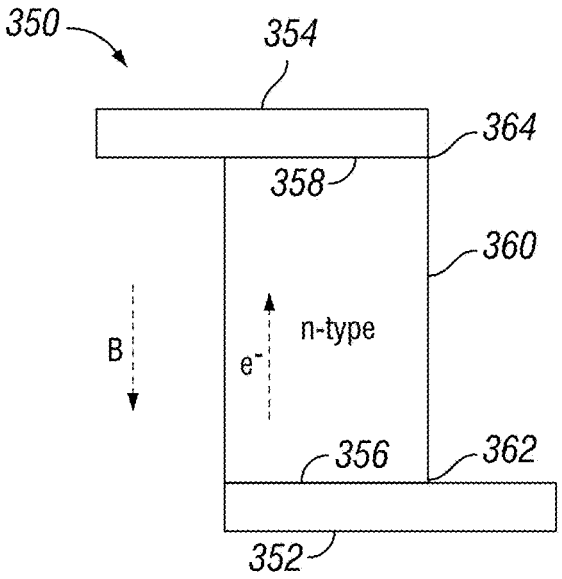

Referring to FIGS. 3*a* and 3*b*, examples of thermoelectric elements 300 and 350, respectively, in accordance with principles disclosed herein, are shown. In some embodiments, the active cooling module 200 shown in FIG. 2 may comprise one or more of thermoelectric elements 300 and/or 350. Thermoelectric elements 300 and 350 comprise exemplary Peltier-type thermoelectric semiconductor materials in accordance with principles disclosed herein.

Particularly, the thermoelectric element shown in FIG. 3*a* comprises p-type semiconductor material. Generally, a p-type semiconductor material comprises positively charge carriers ($p^+$), often referred to as holes, causing electrical current to flow from a cold end 312 towards a hot end 314 in response to an electric field. In this exemplary embodiment, current flows from a first electrical contact 302 through p-type semiconductor material 310 to a second electrical contact 304. As electrical current flows, positive charge carriers ($p^+$) are generated at the cold junction or interface 306 between the first electrical contact 302 and the p-type semiconductor material 310, absorbing heat at cold end 312 of thermoelectric element 300 and which flows towards hot end 314 of thermoelectric element 300, through the second electrical contact 304, and into the surrounding electrical circuit.

The thermoelectric element 350 shown in FIG. 3*b* comprises n-type semiconductor material. Generally, an n-type semiconductor material comprises negatively charged electrons ($e^-$), causing electrical current to flow from a cold end 362 towards a hot end 364 in response to an electric field. In this exemplary embodiment, current flows from a first electrical contact 352 through n-type semiconductor material 360 to a second electrical contact 354. As electrical current flows, negative charge carriers ($e^-$) are generated at the cold junction or interface 356 between the first electrical contact 352 and the n-type semiconductor material 360, absorbing heat at cold end 362 of thermoelectric element 350, and flow towards hot end 364 of thermoelectric element 350 and condense heat at the hot interface 358 where the heat is released.

Generally, in both p-type and n-type semiconductor elements, charge carriers are produced at the cold ends and migrate towards the hot ends where they recombine or condense. Thus, by arranging thermoelectric elements of alternating carrier types and connecting them in an electrical series configuration, a unified current flow is maintained through the thermoelectric elements, while they act thermally in parallel. This configuration enables the generation of a temperature difference, $\Delta T$, between the hot and cold end temperatures during operation of an active cooling module comprising said thermoelectric elements such as, for example, the active cooling module 200 shown in FIG. 2.

Figure 4:
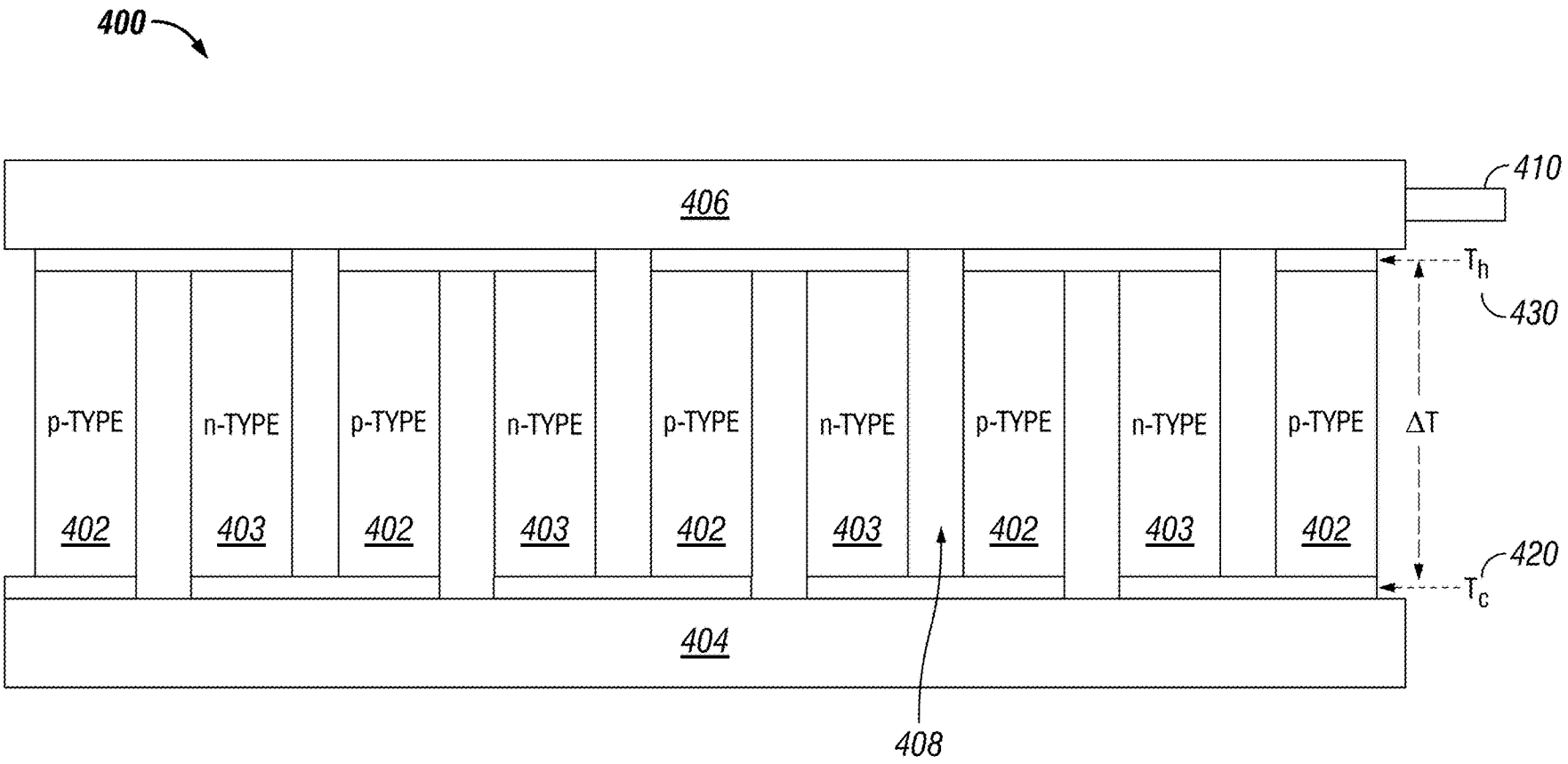
FIG. 4 is a schematic diagram of an exemplary thermoelectric module in accordance with principles disclosed herein.

Referring to FIG. 4, a schematic diagram of an exemplary thermoelectric module 400 in accordance with principles disclosed herein is shown. In this exemplary embodiment, thermoelectric module 400 comprises features of thermoelectric element 300 shown in FIG. 3*a* and/or the thermoelectric element 350 shown in FIG. 3*b*. Particularly, thermoelectric module 400 of FIG. 4 comprises a plurality of p-type and n-type thermoelectric materials 402 and 403, respectively, that are electrically connected in parallel with thermal junctions or interconnects 408, a pair of opposing thermal contacts 404, 406, and an electrical connection 410 through which electrical power may be supplied to the thermoelectric module 400. Thermal contacts 404, 406, together with interconnects 408 act as a thermal conductor and electrical insulator and couple thermal energy to and from both ends of the thermoelectric module 400 without shunting electrical current traversing thermoelectric module 400.

In this exemplary embodiment, the first thermal contact 404 is placed in thermal communication with the cold ends of the plurality of p-type and n-type thermoelectric materials 402 and 403, respectively, to define a substantially isothermal cold end 420 and achieve a desired temperature $T_c$ during operation. In addition, the second thermal contact 406 is placed in thermal communication with the hot ends of the plurality of p-type and n-type thermoelectric materials 402 and 403, respectively, to define a substantially isothermal hot end 430 and achieve a temperature $T_h$ during operation, thereby creating a temperature differential ($\Delta T$) between the isothermal cold end 420 and isothermal hot end 430.

Figure 5:
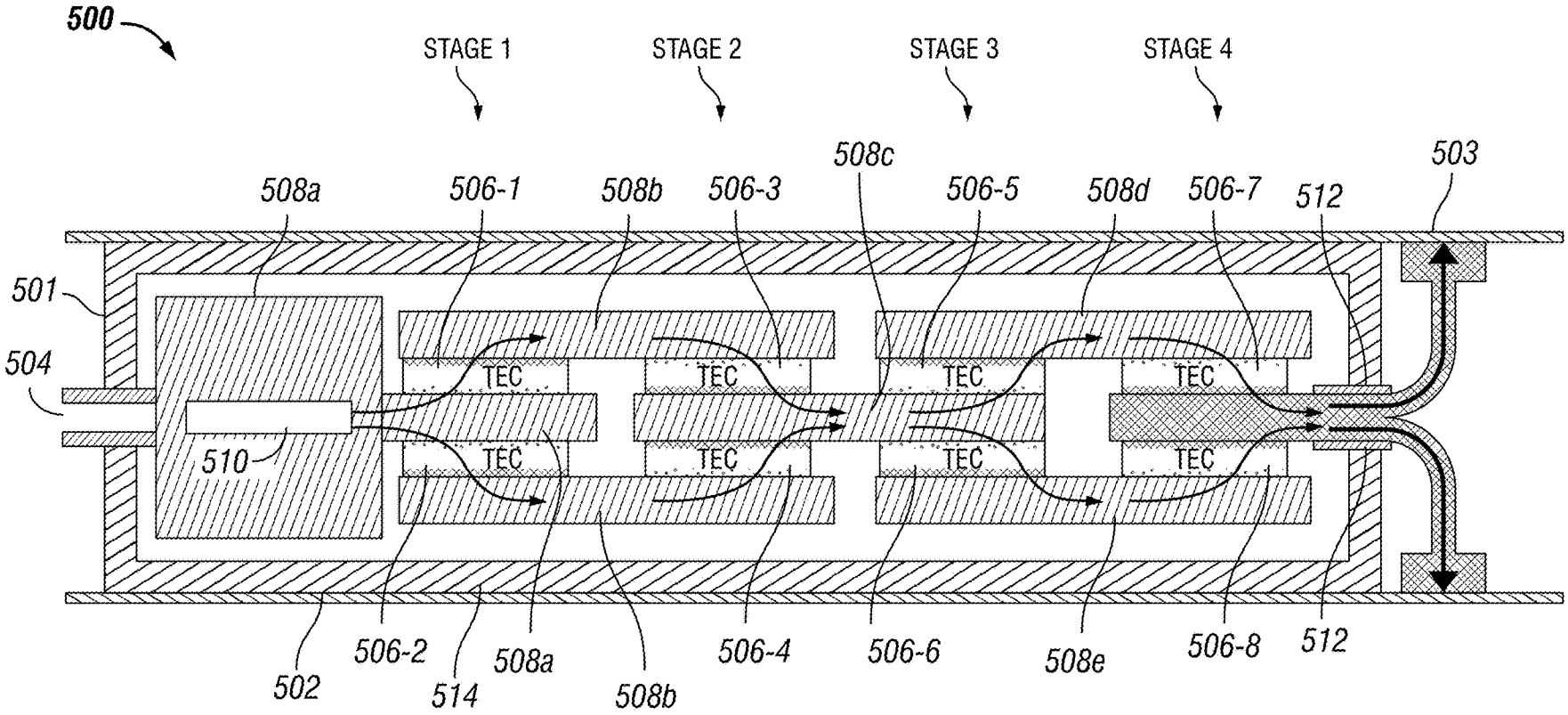
FIG. 5 a schematic diagram of an exemplary embodiment of an active cooling system using one or more thermoelectric coolers (TECs) in a downhole assembly deployed in a wellbore in accordance with principles disclosed herein.

Referring to FIG. 5, a schematic diagram of an exemplary embodiment of an active cooling system using one or more thermoelectric coolers (TECs) implemented in a downhole tool or assembly deployed in a wellbore in accordance with principles disclosed herein is shown. Particularly, FIG. 5 shows an embodiment of a multi-stage downhole cooling system 500. In this exemplary embodiment, each discrete stage of multi-stage cooling system 500 comprises a plurality or array of single stage TEC modules deployable in a wellbore. As used herein, the term "stage" with respect to a multi-stage cooling system such as multi-stage downhole cooling system 500 refers to a cooling step in a downhole cooling system where heat is transferred by one or more TECs of the stage away from a heat source (e.g., an electronic device) and towards a heat sink. The number of stages of a given multi-stage cooling system such as multi-stage downhole cooling system 500 may depends on the overall ΔT requirement (i.e., well ambient—electronics limit temperature) and the optimum change in temperature (ΔT) per stage.

In this exemplary embodiment, multi-stage downhole cooling system 500 combines thermoelectric cooling with heat conductors (e.g., a heat pipe or other structure) to transfer heat from a heat source, such as one or more electronic devices, to a downhole ambient environment. In this exemplary embodiment, multi-stage downhole cooling system 500 generally includes a cylindrical outer housing 502 extending from an uphole end 501 to a downhole end 503 and defining an inner or internal cavity or opening, a wiring conduit 504, a plurality of TECs 506 (shown as TECs 506-1, 506-2, 506-3, 506-4, 506-5, 506-6, 506-7, and 506-8 in FIG. 5), a plurality of different phase change materials (PCM) chasses 508 (shown as 508*a*, 508*b*, 508*c*, and 508*d* in FIG. 5), a heat source comprising an electronic device 510, one or more heat conductors 512, and a thermal insulator 514 comprising thermal insulation material (TIM) positioned in housing 502. Particularly, in this exemplary embodiment, thermal insulator 514 defines an inner thermally insulated cavity or chamber 515 in which the electronic device 510, TECs 506, and PCM chasses 508 are positioned. Insulated chamber 515 is thermally insulated from the surrounding environment by the thermal insulator 514 which includes only a limited number of predefined openings (e.g., for the passage of wiring conduit 504 and heat conductors 512).

In this exemplary embodiment, the plurality of TECs 506 are organized into cascading stages that split the overall change in temperature across the plurality of TECs 506 so as to achieve a desired or optimum ΔT per TEC stage. Particularly, in this embodiment, multi-stage downhole cooling system 500 comprises a multi-stage array of single stage TECs 506 where "an initial stage or stage 1" comprises TECs 506-1, and 506-2, a subsequent or stage 2 (located downstream from stage 1 in terms of thermal flow) comprises TECs 506-3 and 506-4, a stage 3 comprises TECs 506-5 and 506-6, and a stage 4 comprises TECs 506-7 and 506-8. The configuration and number of TECs 506 per stage of multi-stage downhole cooling system 500 may be based on the total heat pumping requirement ($Q_c$) of the given application, which refers to the sum ($Q_{source}$+$Q_{conditions}$) of heat flux rejection from the heat source ($Q_{source}$) (e.g., electronic device 510) and heat flux from outside or external the downhole cooling system ($Q_{conditions}$) (e.g., external housing 502), along with the desired ΔT per stage.

Electronic device 510 is coupled to or mounted on a PCM chassis 508*a*. As used herein, the term "PCM chassis" refers to a chassis or other physical member (e.g., a connector, a mount, a housing) comprising one or more PCMs and which is coupled to or between one or more TECs of a downhole cooling system for conducting heat from a heat source, through the PCM chassis, and to a heat sink. In this manner, PCM chasses 508 of multi-stage downhole cooling system 500 thermally link or couple the different cooling stages of multi-stage downhole cooling system 500 whereby heat may be transferred in series from Stage 1 to Stage 2, from Stage 2 to Stage 3, and so on. Generally, PCMs are configured to undergo phase changes during operation of the system into which they are incorporated (e.g., a downhole cooling system such as multi-stage downhole cooling system 500) whereby the PCMs may store large amounts of heat as a result of undergoing a phase change (e.g., a phase change from solid to liquid). PCMs may comprise waxes, salts, paraffins, but may vary depending on the application such as the operating temperatures of the application.

In this exemplary embodiment, PCM chassis 508*a* is thermally coupled to the cold sides of TEC 506-1 and 506-2 disposed proximal uphole end 501. Electronic device 510 is also coupled to wiring conduit 504 which is also disposed proximal uphole end 501, and is surrounded by PCM chassis 508*a*. Wiring conduit 504 provides an opening to the insulated chamber 515 of housing 502 whereby one or more electrical conductors may extend to connect with and power electronic device 510. In this manner, wiring conduit 504 protects the wiring and electronic connections of electronic device 510 from mechanical damage, harsh downhole conditions, corrosive fluids, and the like. In this exemplary embodiment, the PCM chasses 508*a*, 508*b*, 508*c*, and 508*d* serve to stabilize the temperature within the multi-stage downhole cooling system 500. For instance, PCM chassis 508*a* may buffer electronic device 510 in case of power failure. For example, during operation, electronic device 510 may generate excess heat which is absorbed by PCM chassis 508*a* and later released when a power outage occurs to thereby maintain stable operation of electronic device 510. PCM chasses 508*a*, 508*b*, 508*c*, and 508*d* may be similarly or differently configured (e.g., made from similar or different materials) depending on the given application. This cascaded configuration may overcome heat pump capacity limitations of at least some existing thermoelectric materials. Particularly, by cascading horizontally to split overall delta T across TECs 506, an optimum ΔT per TEC stage may be achieved. As previously described, the number of TECs 506 per stage is based on the total heat pumping requirement as the sum of the heat flux rejection from electronic device 510 and heat flux from outside the multi-stage downhole cooling system 500. Each stage can be an array of single stage TEC modules or an array of multi-stage TEC modules. The number of stages may depend on the overall ΔT requirement (i.e., well ambient—electronics limit temperature) and optimum ΔT per stage. PCM choice (maximum latent heat, phase change temperature) may depend on the heat pumping requirements of the application, and TEC optimal operating temperature and minimum ΔT.

In this exemplary embodiment, TECs 506 function as heat removing elements while the one or more heat conductors 512 serves as a thermal conduit and may comprise of solid conductors such as metal rods and plates, heat pipes (which consists of pipe material such as copper, nickel or titanium; and working fluids such as acetone, sodium, cesium and potassium), vapor chambers, graphite sheets, composite materials such as carbon fiber composites and graphene, and even liquid cooling systems. As previously described, the cold sides of TEC 506-1 and 506-2 are thermally coupled to electronic device 510 through PCM chassis 508*a* to absorb heat from electronic device 510 and provide an initial cooling effect, while the opposing hot sides of TEC 506-1 and 506-2 release, via PCM chasses 508*b* and 508*c* (thermally coupling TECs 506-3 and 506-4 with TECs 506-1 and 506-2), the absorbed heat to the cold side of TEC 506-3 and TEC-506-4, respectively. Similarly, the cold sides of TEC 506-3 and TEC 506-4 are thermally coupled to the corresponding hot sides of TEC 506-1 and 506-2, respectively, and further absorb heat released by the hot sides of TEC 506-1 and TEC 506-2.

In this exemplary embodiment, the hot sides of TEC 506-3 and TEC 506-4 release via PCM chasses 508*d* and 508*e* (thermally coupling TECs 506-7 and 506-8 with TECs 506-5 and 506-6), heat to the cold sides of TEC 506-5 and 506-6. The cold sides of TEC 506-5 and TEC 506-6 are thermally coupled to the hot sides of TEC 506-3 and 506-4, respectively, to absorb heat released by TEC 506-3 and TEC 506-4. In turn, the hot sides of TEC 506-5 and TEC 506-6 are thermally coupled to the cold sides of TEC 506-7 and TEC 506-8, respectively. The hot sides of TEC 506-5 and TEC 506-6 release heat to the cold sides of TEC 506-7 and TEC 506-8, respectively. Correspondingly, the cold sides of TEC 506-7 and TEC 506-8 are thermally coupled to the hot sides of TEC 506-5 and 506-6 and absorb the heat released by TEC 506-5 and 506-6, respectively.

In this exemplary embodiment, the hot sides of TEC 506-7 and TEC 506-8 of the fourth or final stage of the multi-stage downhole cooling system 500 release heat to heat conductors 512 which extend from the insulated chamber 515 of thermal insulator 514, through an opening formed therein (opposite wiring conduit 504 in this exemplary embodiment) to an exterior of the thermal insulator 514. Particularly, in this exemplary embodiment, heat conductors 512 have a first longitudinal end thermally coupled to the hot sides of TECs 506-7 and 506-8 and which is thus located within insulated chamber 515, and a longitudinally opposed second end thermally coupled to the housing 502 and which is external the thermal insulator 514. In this configuration, heat conductors 512 pump or transfer heat from the final stage of multi-stage downhole cooling system 500 to the housing 502 thereof.

The hot sides of TEC 506-7 and 506-8 are thermally coupled to the hot sides (e.g., an evaporator section) of heat conductors 512. The heat conductors 512 transfer the accumulated heat from TEC 506-7 and TEC 506-8 to a condenser section thereof to induce a thermal gradient across the multi-stage downhole cooling system 500 and thereby conduct a heat flux to an external heat sink (e.g., drilling mud or other fluids used in the wellbore) which may vary in configuration depending on the given application and/or operating conditions.

In this exemplary embodiment, the insulated chamber 515 of housing 502 is lined with the TIM of thermal insulator 514. Thermal insulator 514 may be configured to slow or stop heat flux from the external environment and minimize the heat pump capacity per stage (i.e., the number of TEC modules per stage for the downhole cooling system). In other words, thermal insulator 514 serves to minimize heat transfer from the surrounding downhole environment to the interior of the downhole tool, thereby maintaining the electronic device 510 at a lower, safe operating temperature for extended periods. In some embodiments, multi-stage downhole cooling system 500 may not include thermal insulator 514.

Figure 6:
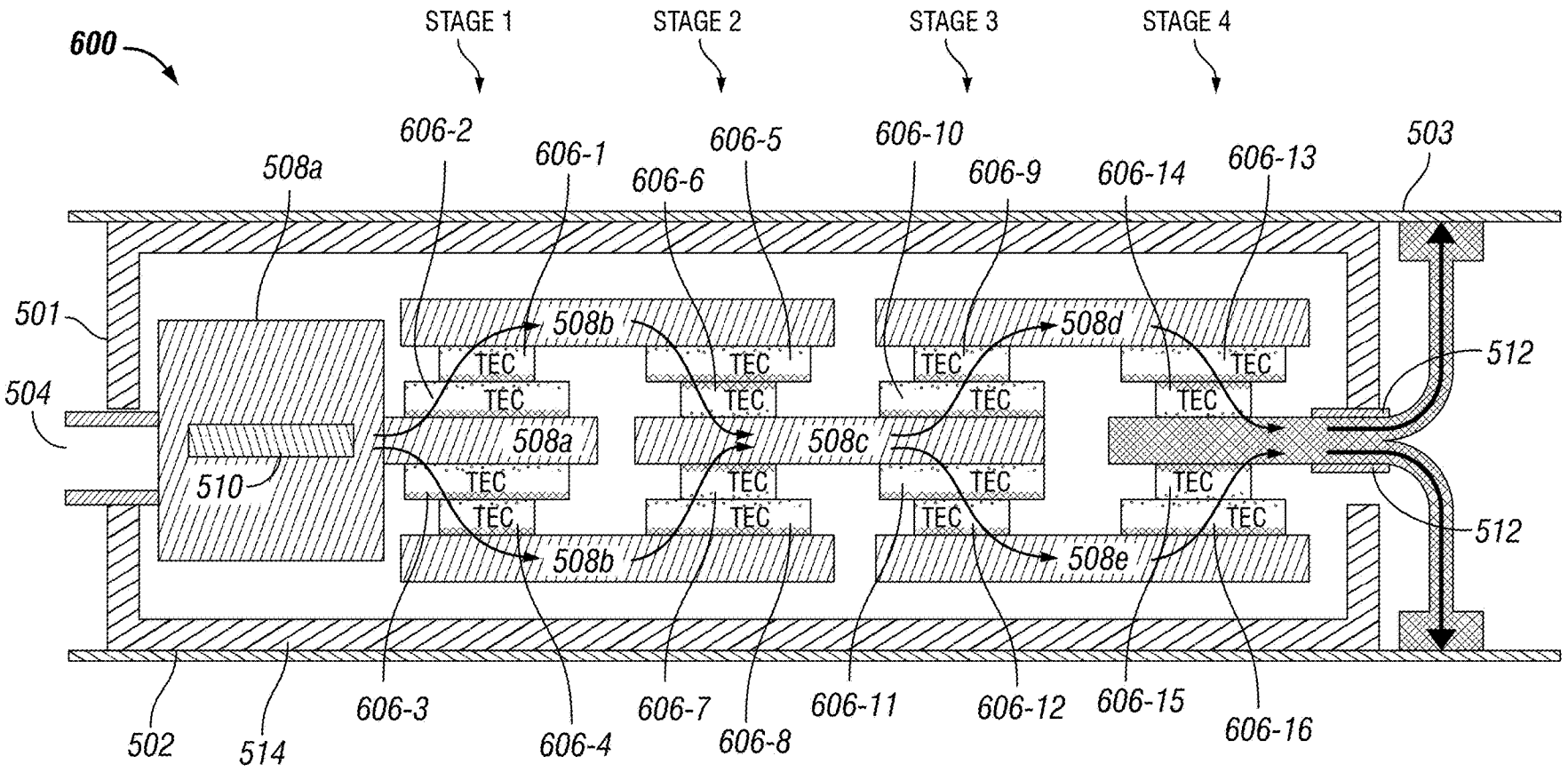
FIG. 6 is a schematic diagram of another exemplary embodiment of an active cooling system using one or more TECs in a downhole assembly deployed in a wellbore in accordance with principles disclosed herein

Referring now to FIG. 6, another exemplary embodiment of a multi-stage downhole cooling system 600 is shown, where each stage comprises an array of multi-stage TEC modules deployed in a well bore (e.g., lined by a casing string) and through which fluids (e.g., drilling fluid) flow.

Multi-stage downhole cooling system 600 includes features in common with multi-stage downhole cooling system 500 shown in FIG. 5, and shared features are similarly labeled. Particularly, multi-stage downhole cooling system 600 is configured similarly as multi-stage downhole cooling system 500 except that each stage comprises an array of multi-stage, rather than single-stage, TECs 606 (labeled as TECs 606-1 through 606-16 in FIG. 6). As used herein, the term "multi-stage TEC" refers to a plurality of TECs that are directly thermally coupled together (e.g., with the cold side of an upstream TEC directly thermally coupled to the hot side of a downstream TEC) without an intervening PCM chassis. In this configuration, stage 1 of multi-stage downhole cooling system 600 comprises TECs 606-1, 606-2, 606-3 and 606-4; stage 2 of multi-stage downhole cooling system 600 comprises TECs 606-5, 606-6, 606-7 and 606-8; stage 3 of multi-stage downhole cooling system 600 comprises TECs 606-9, 606-10, 606-11 and 606-12; and stage 4 comprises TECs 606-13, 606-14, 606-15 and 606-16. In this embodiment, the plurality of TECs 606 are set up in an array of multi-stage TEC modules cascaded horizontally to split the overall ΔT across the plurality of multi-stage TECs 606 to achieve optimum ΔT per TEC stage. As previously described, the choice and number of TECs 606 per stage is based on the total heat pumping requirement. For example, generally, multi-stage TECs may be used when the overall ΔT cannot be achieved in a practical number of stages. In this manner, a multi-stage TECs is used to boost the maximum ΔT achievable by a single TEC stage. In other words, multi-stage TECs may be used to optimize the number of ΔT split. The choice of the PCMs and the number of stages may determine the optimum ΔT across the TECs whether single stage or multi-stage.

Similar to TECs 506 of the multi-stage downhole cooling system 500 shown in FIG. 5, TECs 606 function as heat removing elements while the one or more heat conductors 512 serves as a thermal conduit. In this exemplary embodiment, the cold side of TEC 606-1 is directly thermally coupled to the corresponding hot side of TEC 606-2 with no intervening PCM chassis 508 positioned therebetween whereby TECs 606-1 and 606-2 collectively define a first multi-stage TEC of Stage 1 of the multi-stage downhole cooling system 600. Similarly, TECs 606-3 and 606-4 collectively define a second multi-stage TEC of Stage 1 of multi-stage downhole cooling system 600. In addition, TECs 606-5/606-6, and TECs 606-7/606-8 define multi-stage TECs of Stage 2, TECs 606-9/606-10, and TECs 606-11/606-12 define multi-stage TECs of Stage 3 of multi-stage downhole cooling system 600. Further, TECs 606-13/606-14 and TECs 606-15/606-16 define multi-stage TECs of Stage 4 of multi-stage downhole cooling system 600.

Figure 7:
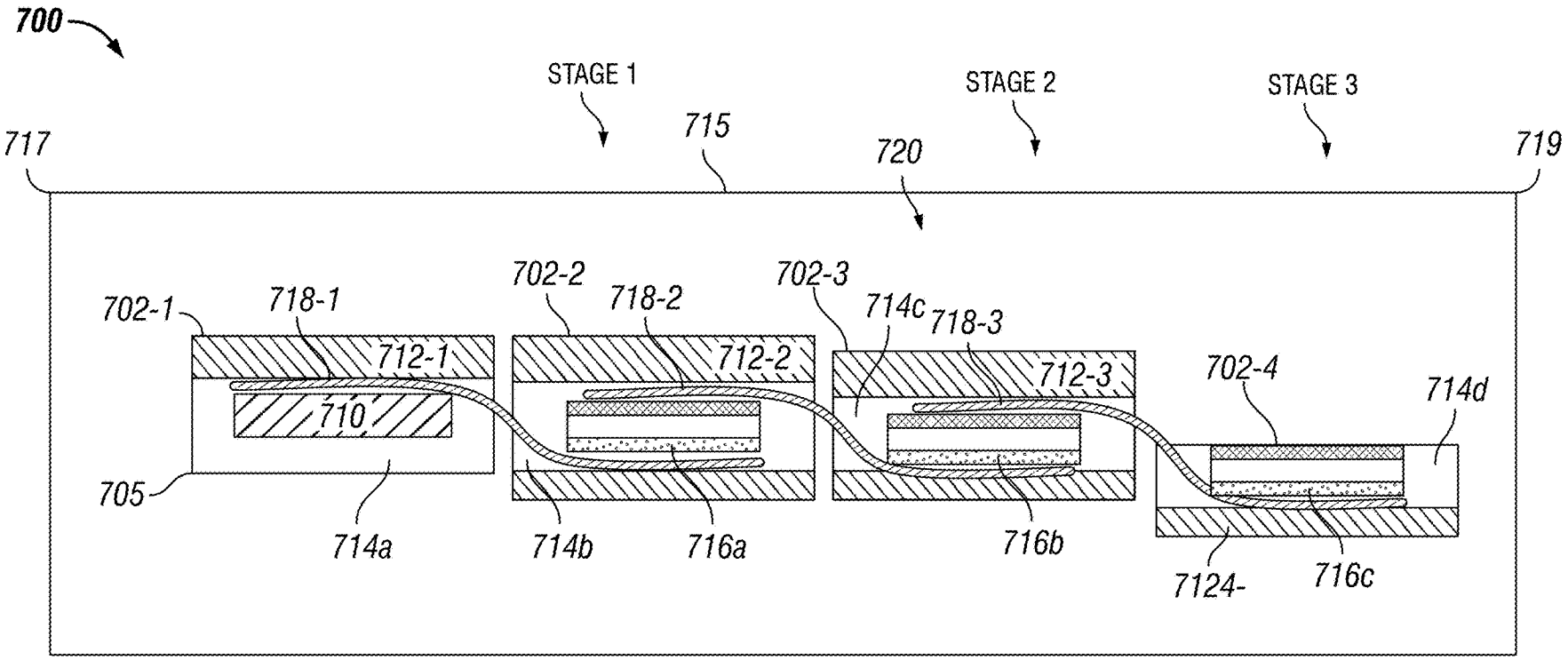
FIG. 7 is a schematic diagram of another exemplary embodiment of an active cooling system using one or more TECs in a downhole assembly deployed in a wellbore in accordance with principles disclosed herein.

While multi-stage downhole cooling systems 500 and 600 each include a single insulated chamber 515, in other embodiments, a given downhole cooling system may include a plurality of insulated chambers. Referring now to FIG. 7, a schematic diagram of another exemplary embodiment of a multi-stage downhole cooling system 700 in accordance with principles disclosed herein is shown where each stage of multi-stage downhole cooling system 700 comprises a plurality of heat cascading, thermally insulated cavities or chambers. Particularly, in this exemplary embodiment, multi-stage downhole cooling system 700 combines different TEC material and different PCMs at varying temperatures to transfer heat from a heat source (e.g., an electronic device 710 as shown in FIG. 7) to a heat sink in the form of the downhole environment, along with thermal insulation to minimize heat transfer to the ambient environment. In some embodiments, each or at least some of the different insulated chambers contain differently configured TECs (e.g., TECs having different materials) optimized for different PCM operating temperatures with a low ΔT.

In this exemplary embodiment, multi-stage downhole cooling system 700 generally includes a plurality of insulated cavities or chambers 702 (labeled as 702-1 through 702-4 in FIG. 7) each defined by a separate surrounding enclosure or housing 705. Additionally, multi-stage downhole cooling system 700 includes an outer housing 715 extending from a uphole end 717 to a downhole end 719 and which defines an inner passage or cavity 720 in which the plurality of insulated chambers 702 are received. Multi-stage downhole cooling system 700 further includes an electronic device 710 received in insulated chamber 702-1, TIM 712 (labeled as 712-1 through 712-4 in FIG. 7) received in the different insulated chambers 702, a plurality of PCMs 714*a*, 714*b*, 714*c* and 714*d* each received in or filling (e.g., entirely filling so as to leave no voids) a corresponding insulated chamber 702, a plurality of TECs 716*a*, 716*b*, and 716*c* received in insulated chambers 702-2, 702-3, and 702-4, respectively, and a plurality of heat conductors 718 (labeled as 718-1 through 718-3 in FIG. 7) extending between to thermally couple in series the plurality of insulated chambers 702-1 through 702-4. In this exemplary embodiment, the TEC 716*a*-716*c* and/or PCM 714*a*-714*d* has a predefined, selected operating temperature (e.g., an operating temperature range having predefined upper and lower bounds) that is specific or unique to the given insulated chamber 702 where the efficiency of the respective TEC 716*a*-716*d* and/or PCM 714*a*-714*d* is tuned or optimized to the selected operating temperature.

Multi-stage downhole cooling system 700 is configured with a plurality of insulated chambers 702-1 through 702-4 stacked in series to provide cooling of downhole equipment such as electronic device 710. Outer housing 715 may comprise a cylindrical tool housing threadably or otherwise mechanically connected with adjoining tools of a toolstring, a workstring, a drillstring, and the like. In this exemplary embodiment, multi-stage downhole cooling system 700 includes four chambers 702-1, 702-2, 702-3, 702-4 moving from uphole end 717 to downhole end 719. However, multi-stage downhole cooling system 700 may comprise fewer or more than four insulated chambers 702 depending on the application.

For example, multi-stage downhole cooling system 700 may theoretically comprise n-number of insulated chamber serially stacked to progressively higher temperatures, where the PCMs (e.g., PCMs 714*a*-714*n* in this example) located or filling each insulated chamber (e.g., insulated chambers 702-1 through 702-*n* in this example) may be activated only when the ambient temperature (e.g., temperature within cavity 720 of outer housing 715) achieves a predefined threshold that is associated with or unique to the particular PCM. In other words, each insulated chamber 702 may have a specific or unique activation temperature that, once achieved, drives a phase change in the given PCM 714*a*-714*d* of the specific insulated chamber 702. As an example, during operation of multi-stage downhole cooling system 700 (e.g., in a downhole environment), the PCM 714*a* of uphole insulated chamber 702-1 may operate at 200 degrees Celsius (°C) (e.g., electronic device 710 and PCM 714*a* are each at approximately 200 °C), PCM 714*b* of adjacently downhole insulated chamber 702-2 may operate at 250 °C (with TEC 716*a* providing a ΔT of 50 °C), and the PCM 714*c* of adjacently downhole insulated chamber 702-3 may operate at 300 °C (with TEC 716*b* providing a ΔT of 50 °C). Finally, the PCM 714*d* of the final and downhole insulated chamber 702-4 may operate at the temperature of the heat sink, such as 350 °C or higher depending on the number of stages (with TEC 716*c* providing a ΔT of 50 °C).

In this embodiment, Electronic device 710 is mounted on chamber 702-1 and is thermally coupled to the cold side of TEC 716*a* via heat conductors 718-1. The cold side of TEC 716*a* absorb heat from electronic device 710 and provide an initial cooling effect, while the hot side of TEC 716*a* release the absorbed heat to the cold side of TEC 716*b* at stage 1. The cold side of TEC 716*b* is thermally coupled to the hot side of TEC 716*a* via heat conductor 718-2. The cold side of TEC 716*b* further absorbs the heat released by TEC 716*a* lowering the temperature further at stage 2. The hot side of TEC 716*b* releases heat to the cold side of TEC 716*c*. The cold side of TEC 716*c* is coupled to the hot side of TEC 716*b* via heat conductor 718-3 and further absorbs the heat released by TEC 716*b* lowering the temperature even further at stage 3. The hot side of TEC 716*c* is coupled to a heat sink. The hot side of TEC 716*c* releases the accumulated heat to the heat sink, thereby maintaining the temperature in multi-stage downhole cooling system 700.

Figure 8:
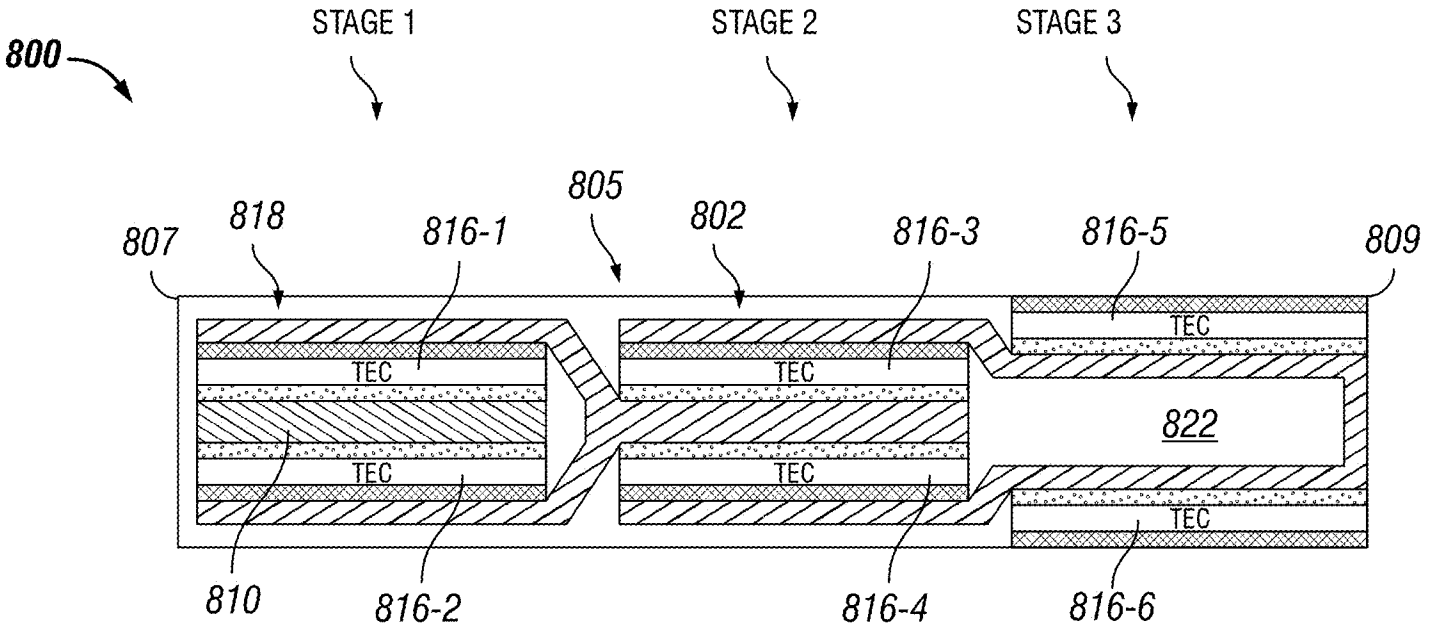
FIG. 8 is a schematic diagram of another exemplary embodiment of an active cooling system using one or more TECs in a downhole assembly deployed in a wellbore in accordance with principles disclosed herein.

Referring now to FIG. 8, a schematic diagram of another exemplary downhole cooling system in accordance with principles disclosed herein is shown. Particularly, FIG. 8 shows an example of an insulated chamber 802 of a multi-stage downhole cooling system 800 (the other insulated chambers 802 of system 800 not shown in FIG. 8) where each stage comprises multiple heat cascading chambers and each stage comprises a plurality or array of multi-stage TEC modules. Multi-stage downhole cooling system 800 combines thermoelectric cooling with heat conductors and inert gas or vacuum for insulation to transfer heat from a power source to a downhole ambient environment. In some embodiments, multi-stage downhole cooling system 800 may be configured similarly as multi-stage downhole cooling system 700 shown in FIG. 7 with insulated chambers 802 replacing the insulated chambers 702 shown in FIG. 7. In this exemplary embodiment, the insulated chamber 802 of multi-stage downhole cooling system 800 is defined by an enclosure or housing 805 extending from a first end 807 to a second end 809. Additionally, multi-stage downhole cooling system 800 includes a heat source in the form of an electronic device 810, a plurality of TECs 816 (labeled as TECs 816-1, 816-2, 816-3, 816-4, 815-5, and 816-6 in FIG. 8), and one or more heat conductors 818 extending between and thermally coupling the different TECs 816 in a staged or cascaded configuration, and TIM 822 (e.g., physical material such as an inert gas or a vacuum) each of which are contained in the insulated chamber 802.

In this embodiment, multi-stage downhole cooling system 800 is configured with electronic device 810 thermally coupled to the cold sides of TECs 816-1 and 816-2 which absorbs the heat and provide initial cooling. The hot sides of 816-1 and 816-2 are coupled to the cold sides of TECs 816-3 and 816-4 via heat conductor 818. The hot sides of 816-1 and 816-2 release the heat to the cold sides of TECs 816-3 and 816-4 respectively. The hot sides of TECs 816-3 and 816-4 are coupled to the cold sides of TECs 816-5 and 816-6 respectively via heat conductor 818. The hot sides of 816-3 and 816-4 releases the heat to the cold sides of TECS 816-5 and 816-6 respectively to provide further cooling. The hot sides of TECS 816-5 and 816-6 may be coupled to a heat sink for the final stage of cooling. Inert gas/vacuum chamber 820 is coupled to heat conductors 818 on the distal end 819 and is configured to stop or slow heat flux from the well casing and minimize heat pump capacity per TEC stage. In this manner, a plurality of serially arranged, discrete cooling stages are defined by insulated chamber 802 including Stage 1 (comprising TECs 816-1 and 816-2), Stage 2 (comprising TECs 816-3 and 816-4), and Stage 3 (comprising TECs 816-5 and 816-6). Incorporated with additional insulated chambers 802 (e.g., in series), multi-stage downhole cooling system 800 provides multi-layered (e.g., stages nestled within stages) temperature cascading across the multi-stage downhole cooling system 800 to maximize the efficiency of multi-stage downhole cooling system 800 through minimizing the operational temperature range (e.g., corresponding to an operating or activation temperature of a PCM of the stage) for each stage such that the underlying components of the stage (e.g., the PCM and/or one or more TECs) may operate more efficiently.

Figure 10:
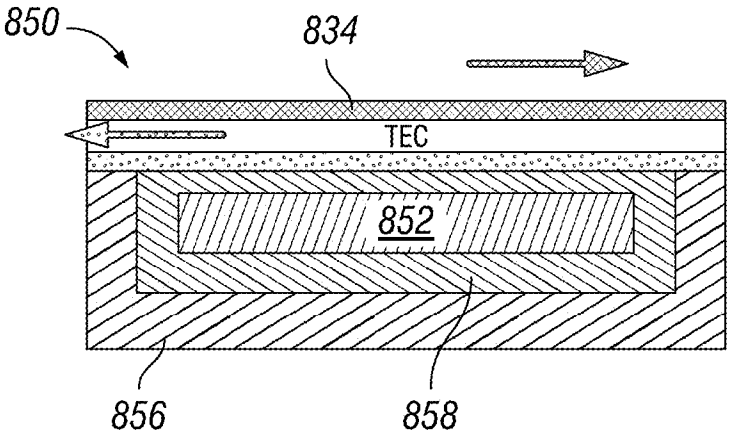
FIGS. 9 to 11 are schematic diagrams of exemplary embodiments of an active cooling systems using single stage one or more TECs in a downhole assembly deployed in a wellbore in accordance with principles disclosed herein.
Figure 9:
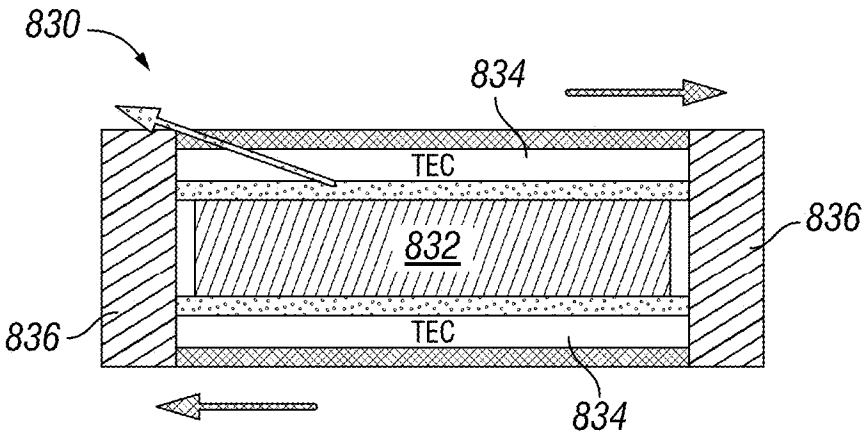
Figure 11:
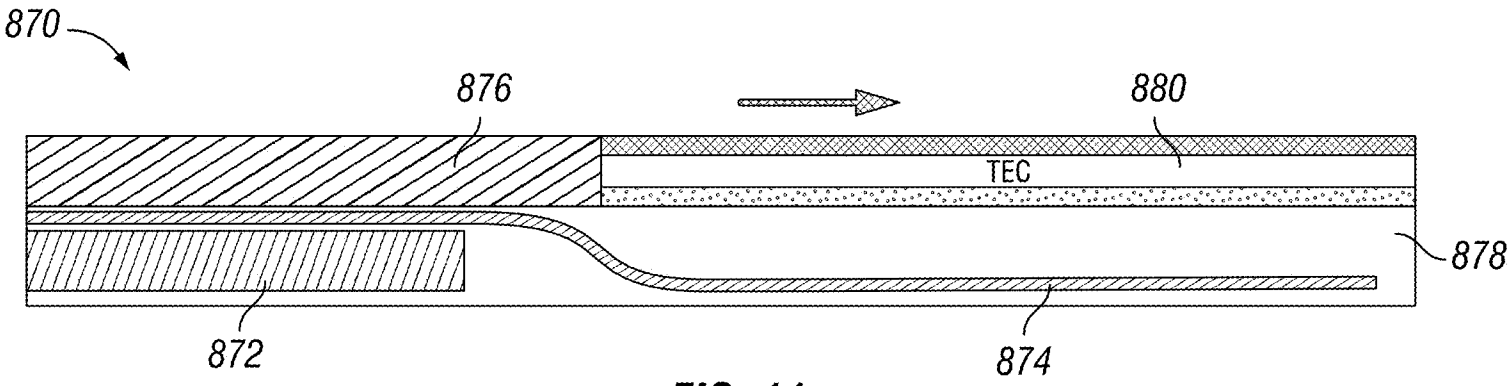

In some applications, other design considerations such as the physical space or volume (or other size-specific parameters) of the downhole cooling system may predominate such that a single stage downhole cooling system is preferable over a multi-staged system. Referring now to FIGS. 9-11, schematic diagrams of exemplary single stage active downhole cooling systems using TECs (which may be incorporated into a downhole cooling tool) in accordance with principles disclosed herein is shown. Particularly, FIG. 9 shows a single stage downhole cooling system 830 comprising an electronic device 832 sandwiched between multiple TECs 834. TECs 834 are bounded or sandwiched between thermal insulators 836 each comprising TIM. TECs 834 operate with a relatively high ΔT (e.g., greater than 50 °C) and a high ZT value as compared with, for example, TECs 816 shown in FIG. 8. In this configuration, the cold sides of TECs 834 are directly thermally coupled to electronic device 832 while the opposing hot sides thereof are directly thermally coupled to the corresponding heat sink (e.g., with electronic device 832 operating at 220 °C, for example, and the heat sink at 300 °C).

FIG. 10 shows another exemplary single-stage downhole cooling system 850 comprising an electronic device 852 surrounded or encased in a PCM 854. In addition, single-stage downhole cooling system 850 includes a single TEC 856 which may be similar in configuration to TECs 834 shown in FIG. 9. FIG. 11 illustrates another embodiment of a single stage downhole cooling system 870 including an electronic device 872 directly thermally coupled to one or more heat conductors 874 having a first or upstream (with respect to thermal flow) end that is sandwiched between electronic device 872 and a thermal insulator 876 of system 870 comprising TIM, and an opposing second or downstream end that is distal electronic device 872. Further, downhole cooling system 870 includes PCM 878 in which the downstream end of heat conductors 874 are located or encased, and a TEC 880 having a hot side directly thermally coupled to the PCM 878 and an opposing hot side directly coupled to a heat sink.

Figure 12:
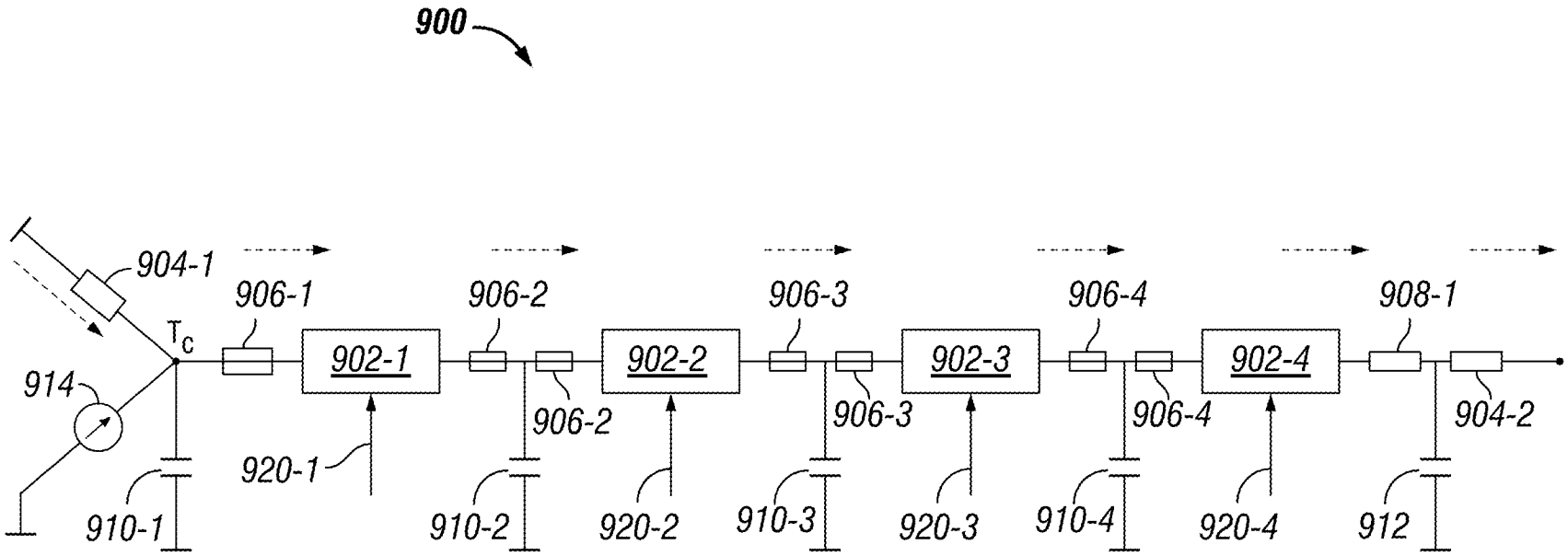
FIG. 12 is a schematic diagram illustrating the thermal network of an active cooling system using multiple TECs in a downhole assembly deployed in a wellbore in accordance with principles disclosed herein.

Referring to FIG. 12, a schematic diagram illustrating an embodiment of an electrical equivalent circuit of a thermal network 900. Thermal circuit 900 may be implemented or embodied by one or more of the various downhole cooling systems described herein in accordance with the principles disclosed herein. Generally, thermal circuit 900 includes a plurality of TECs 902-1 through 902-4, each of which receive electrical power 920-1 through 920-4, respectively. Additionally, thermal circuit 900 includes a plurality of different thermal resistors including an outer housing or insulation resistors 904-1 and 904-2, a plurality of PCM resistors 906-1 through 906-4, and a heat conductor resistor 908. The insulation resistors 904-1 and 904-2 provide insulation around the thermal network 900 to stop or slow heat flux from the well casing. Further, thermal circuit 900 includes a plurality of different thermal capacitors including a plurality of PCM capacitors 910-1 through 910-4, and a heat conductor capacitor 912. Finally, thermal circuit 900 includes a thermal voltage source in the form of device source 914. In this exemplary embodiment, there are generally two sources of heat flow in the circuit: conductive heat flow from the ambient environment and heat flow resulting from energy (e.g., electrical energy) consumed by the device source 914. As previously described, TECs and PCMs are cascaded horizontally to split the overall ΔT across the TECs and achieve optimum ΔT per stage. The PCMs are used to set or clamp the hot side and code side temperatures for optimal ΔT per TEC stage and act as a buffer by providing the necessary thermal inertia to maintain stable operation of the downhole cooling system. Additionally, the number of TECs per stage may depend on the total heat pumping requirement corresponding to the sum of heat flux rejection from device source 914 and heat flux from the ambient environment outside of the well casing along with electrical power consumed at each stage. Further, the number of stages may depend on the overall required ΔT and the optimum ΔT per stage.

Figure 13:
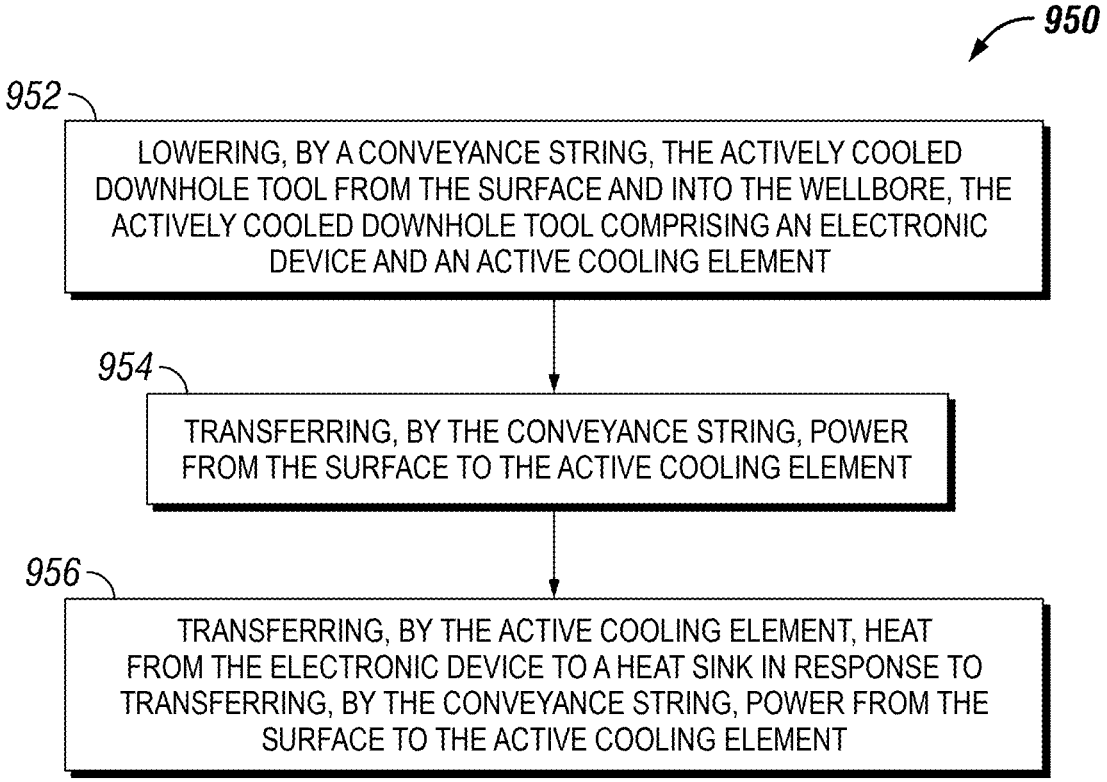
FIG. 13 is a flowchart of an active cooling method for a downhole assembly deployed in a wellbore in accordance with principles disclosed herein.

Referring now to FIG. 13, a flowchart of an active cooling method for a downhole assembly deployed in a wellbore in accordance with principles disclosed herein, is shown. Method 950 begins at step 952 with lowering, by a conveyance string, the actively cooled downhole tool from the surface and into the wellbore. In some embodiments, the conveyance string comprises a powered conveyance string configured to provide continuous power. The conveyance string may include a plurality of tubular members coupled end to end with threaded connections and a fluid passage (e.g., drill pipes, drill collars, or coiled tubing). Furthermore, the actively cooled downhole tool may comprise an electronic device and an active cooling element configured to provide a temperature differential of 50 °C, 100 °C to 200 °C, or greater than 200 °C. The active cooling element may comprise thermoelectric material having a dimensionless figure-of-merit value of 0.5 or greater.

At step 954, method 950 continues with transferring, by the conveyance string, electrical power from the surface to the active cooling element. In some embodiments, the conveyance string comprises an electrical power conductor extending along the conveyance string and connected to a surface electrical power source. As previously described, the surface electrical power source may comprise one or more electrical generators driven by one or more prime movers each comprising an internal combustion engine such as a piston engine, a gas turbine, and the like, an electrical connection (e.g., an electrical switchgear) with an electrical power grid that services the location of the wellsite of a well system, an electrical battery or bank of electrical batteries, and other power supply sources.

Method 950 continues at step 956 with transferring, by the active cooling element, heat from the electronic device to a heat sink in response to transferring, by the conveyance string, electrical power from the surface to the active cooling element. In some embodiments, the downhole cooling system combines thermoelectric cooling with heat conductors to transfer heat from a heat source, such as one or more electronic devices, to a downhole ambient environment. In this manner the thermoelectric cooler may absorb or release heat depending on the direction of electrical current flow through the TEC responsive to electrical power received from the surface.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A well system, comprising:

a surface electrical power source located at a surface located atop a subsurface region;

a conveyance string extending from the surface and into a wellbore extending from the surface and penetrating into the subsurface region, wherein the conveyance string is electrically connected to the surface electrical power source and comprises a plurality of tubular members each comprising a pair of electrical power connectors and an electrical power conductor extending therebetween, wherein each pair of electrical power connectors comprises electromagnetic connectors each comprising a magnet and an electrically conductive coil wound about the magnet and configured to communicate electrical power electromagnetically between adjacent tubular members without requiring direct physical contact therebetween whereby electrical power is communicable wirelessly between the plurality of tubular members; and an actively cooled downhole tool coupled to the conveyance string, wherein the actively cooled downhole tool comprises:

a tool housing coupled to the conveyance string and comprising a receptacle;

an electronic device received in the receptacle of the tool housing; and an active cooling element coupled to the tool housing and connected to the surface electrical power source through the electrical power conductor to the conveyance string, wherein the active cooling element is configured to transfer heat from the electronic device to a heat sink in response to receiving electrical power from the surface electrical power source.

2. The well system of claim 1, further comprising a phase change material coupled to the active cooling element and configured to absorb heat from the electronic device.

3. The well system of claim 1, wherein the conveyance string is configured to supply continuous power to the active cooling element.

4. The well system of claim 3, wherein the plurality of tubular members of the conveyance string are coupled end to end with threaded connections and a fluid passage.

5. The well system of claim 1, wherein the active cooling element comprises a thermoelectric material.

6. The well system of claim 5, wherein the thermoelectric material has a dimensionless figure-of-merit (ZT) value of 0.5.

7. The well system of claim 1, wherein the active cooling element has an ambient temperature greater than 100 degrees Celsius (C) and up to 600 °C.

8. The well system of claim 7, wherein the active cooling element is configured to provide a temperature differential between 50 degrees Celsius (°C) and 200 °C.

9. The well system of claim 1, wherein the actively cooled downhole tool comprises logging while drilling (LWD) tools, measurement while drilling (MWD) tools, ranging tools, directional steering tools, or any other downhole tools that require electronic components.

10. The well system of claim 1, wherein each pair of electrical power connectors comprises a rotating slip ring connector comprising a rotor, a stator, conductive brushes, and conductive rings configured to allow continuous transmission of electrical power between stationary and rotating parts of adjacent tubular members.

11. The well system of claim 1, wherein the surface electrical power source is configured to supply continuous electrical power through the conveyance string to the active cooling element while the actively cooled downhole tool is deployed in the wellbore at an ambient temperature ranging from 175 degrees Celsius to 220 degrees Celsius.

12. The well system of claim 1, wherein the active cooling element comprises a plurality of thermoelectric coolers arranged in cascading stages, each stage thermally coupled to an adjacent stage by a phase change material configured to stabilize temperature between stages, and wherein the surface electrical power source supplies electrical power continuously to each of the plurality of thermoelectric coolers through the electrical power conductor of the conveyance string.

13. A method for deploying an actively cooled downhole tool in a wellbore extending from a surface and penetrating into a subsurface region located beneath the surface, the method comprising:

(a) lowering, by a conveyance string, the actively cooled downhole tool from the surface and into the wellbore, the actively cooled downhole tool comprising an electronic device and an active cooling element;

(b) transferring, by the conveyance string, electrical power from the surface, through the conveyance string electrically connected to a surface electrical power source, and to the active cooling element, wherein the conveyance string comprises a plurality of tubular members each comprising a pair of electrical power connectors and an elongate electrical power conductor extending therebetween, wherein each pair of electrical power connectors comprises electromagnetic connectors comprising a magnet and an electrically conductive coil wound about the magnet and configured to communicate electrical power electromagnetically between adjacent tubular members without requiring direct physical contact therebetween whereby electrical power is communicated wirelessly between the plurality of tubular members; and (c) transferring, by the active cooling element, heat from the electronic device to a heat sink in response to (b).

14. The method of claim 13, wherein the conveyance string is configured to supply continuous power to the active cooling element.

15. The method of claim 14, wherein the plurality of tubular members of the conveyance string are coupled end to end with threaded connections and a fluid passage.

16. The method of claim 13, wherein the active cooling element comprises a thermoelectric material.

17. The method of claim 16, wherein the thermoelectric material has a dimensionless figure-of-merit (ZT) value of 0.5.

18. The method of claim 13, wherein the active cooling element has an ambient temperature greater than 100 degrees Celsius (°C) and up to 600 °C.

19. The method of claim 18, wherein the active cooling element is configured to provide a temperature differential of between 50 degrees Celsius (°C) and 200 °C.

20. The method of claim 13, wherein the actively cooled downhole tool comprises logging while drilling (LWD) tools, measurement while drilling (MWD) tools, ranging tools, directional steering tools, or any other downhole tools that requires electronic components.

21. An actively cooled downhole tool deployable in a wellbore extending from a surface and penetrating into a subsurface region located beneath the surface, the actively cooled downhole tool comprising:

a tool housing extending between an uphole end, a downhole end opposite the uphole end, and defining a receptacle;

an electronic device receivable in the receptacle of the tool housing;

a tool power connector coupled to the housing at the uphole end thereof for connecting to a mating power connector of a separate tool connected to a surface electrical power source, wherein the tool power connector comprises an electromagnetic connector comprising a magnet and an electrically conductive coil wound about the magnet and configured to communicate electrical power electromagnetically between the tool power connector and the mating power connector without requiring direct physical contact therebetween whereby electrical power is communicable wirelessly between the tool power connector and the mating power connector; and an active cooling element coupled to the tool housing and connected to the tool power connector, wherein the active cooling element is configured to transfer heat from the electronic device to a heat sink in response to receiving electrical power from the surface electrical power source through the tool power connector.

22. The actively cooled downhole tool of claim 21, further comprising an enclosure located in the tool housing and which defines a thermally insulated chamber in which the active cooling element is received.

23. The actively cooled downhole tool of claim 22, wherein the active cooling element comprises a plurality of single stage thermoelectric modules or a plurality of multi-stage thermoelectric modules.

24. The actively cooled downhole tool of claim 22, wherein the enclosure defines a plurality of heat cascading, thermally insulated chambers each containing one or more heat conductors, and one of a plurality of the active cooling elements.

25. The actively cooled downhole tool of claim 24, wherein each of the thermally insulated chamber contains a phase change material.

26. The actively cooled downhole tool of claim 25, wherein the phase change material of each thermally insulated chamber has a unique activation temperature.

27. The actively cooled downhole tool of claim 23, wherein an electronic device is coupled to a thermoelectric module and surrounded by a phase change material.

28. The actively cooled downhole tool of claim 21, wherein the electronic device is coupled to one or more heat conductors having an upstream end that is sandwiched between the electronic device and a thermal insulator and an opposing downstream end that is distal the electronic device.

* * * * *